US009080397B2

(12) United States Patent
Ludwig

(10) Patent No.: US 9,080,397 B2
(45) Date of Patent: Jul. 14, 2015

(54) PIPE HANDLING APPARATUS

(76) Inventor: Darcy Ludwig, Red Deer (CA)

( * ) Notice: Subject to any disclaimer, the term of this patent is extended or adjusted under 35 U.S.C. 154(b) by 0 days.

(21) Appl. No.: 13/434,825

(22) Filed: Mar. 29, 2012

(65) Prior Publication Data

US 2013/0251491 A1 Sep. 26, 2013

Related U.S. Application Data

(60) Provisional application No. 61/613,971, filed on Mar. 21, 2012.

(51) Int. Cl.

| | |
|---|---|
| ***E21B 19/00*** | (2006.01) |
| ***E21B 19/15*** | (2006.01) |
| ***E21B 19/14*** | (2006.01) |
| *B66F 11/00* | (2006.01) |

(52) U.S. Cl.

CPC ..... *E21B 19/155* (2013.01); *E21B 19/14* (2013.01); *B66F 11/00* (2013.01)

(58) Field of Classification Search

CPC ..... E21B 19/155; E21B 19/15; E21B 19/14; E21B 19/00; E21B 19/02; E21B 19/20; B66F 7/0625; B66F 7/0675; B66F 7/08

USPC ..... 414/22.51–22.71, 745.1–746.8

See application file for complete search history.

(56) References Cited

U.S. PATENT DOCUMENTS

| | | | | |
|---|---|---|---|---|
| 3,780,883 | A * | 12/1973 | Brown | 414/22.62 |
| 4,235,566 | A * | 11/1980 | Beeman et al. | 414/22.61 |
| 4,371,302 | A | 2/1983 | Frias et al. | |
| 4,386,883 | A * | 6/1983 | Hogan et al. | 414/22.61 |
| 4,403,898 | A * | 9/1983 | Thompson | 414/22.58 |
| 4,423,994 | A * | 1/1984 | Schefers et al. | 414/22.68 |
| 4,684,314 | A * | 8/1987 | Luth | 414/746.1 |
| 6,533,519 | B1 | 3/2003 | Tolomon et al. | |
| 6,877,942 | B2 * | 4/2005 | Eastcott | 414/22.54 |
| 6,899,510 | B2 | 5/2005 | Morelli et al. | |
| 7,021,880 | B2 | 4/2006 | Morelli et al. | |
| 7,163,367 | B2 | 1/2007 | Handley | |
| 7,404,697 | B2 * | 7/2008 | Thompson | 414/22.58 |
| 7,473,065 | B2 * | 1/2009 | Wells | 414/22.57 |
| 7,614,492 | B2 * | 11/2009 | Muse et al. | 198/468.6 |
| 7,635,249 | B2 * | 12/2009 | Guidroz | 414/746.1 |
| 7,883,309 | B2 * | 2/2011 | Smith et al. | 414/22.55 |
| 2005/0079044 | A1 * | 4/2005 | Handley | 414/745.8 |
| 2005/0238463 | A1 * | 10/2005 | Smith | 414/22.52 |
| 2006/0104746 | A1 * | 5/2006 | Thompson | 414/22.54 |
| 2009/0252576 | A1 * | 10/2009 | Gerber et al. | 414/22.54 |
| 2010/0111646 | A1 * | 5/2010 | Smith et al. | 414/22.61 |

FOREIGN PATENT DOCUMENTS

| | | |
|---|---|---|
| CA | 2224638 | 6/1999 |
| WO | WO 0142618 A1 * | 6/2001 |

* cited by examiner

*Primary Examiner* — Gregory Adams

(74) *Attorney, Agent, or Firm* — Sander R. Gelsing

(57) ABSTRACT

The invention relates in general to pipe handling apparatus to position pipe through a range of horizontal and vertical positions. In one embodiment a pipe handling apparatus comprises a longitudinal base having a longitudinal axis, a boom carrying member slidably mounted to the longitudinal base for axial movement there-along, member actuating means operable to move the boom carrying member axially relative to the longitudinal base, a boom supported by the boom carrying member, the boom having a trough adapted for receiving at least one section of pipe therein and boom actuating means operable to raise and lower the boom.

22 Claims, 16 Drawing Sheets

PRIOR-ART

PIPE HANDLING APPARATUS

CROSS REFERENCE TO RELATED APPLICATION

This application is a regular application of U.S. Provisional Patent Application Ser. No. 61/613,971 filed Mar. 21, 2012 and entitled, "PIPE HANDLING APPARATUS", the entirety of which is incorporated herein by reference.

FIELD OF THE INVENTION

The present invention relates generally to pipe handling systems and in particular to a system for providing pipe to, and receiving pipe from, work floors of a derrick or rig which may be positioned at various heights from the ground.

BACKGROUND OF THE INVENTION

Drill strings of pipe for oil and gas wells are assembled or disassembled vertically on a derrick one joint at a time, and are stored horizontally on pipe racks situated on the ground adjacent the rig. The work floor of the rig is typically elevated substantially above the pipe rack such that transferring sections of pipe to and from the work floor and the racks is necessary and requires careful handling of the heavy pipe to protect the workers and the pipe.

As shown in FIG. 1, a common prior art solution in the context of a transportable trailer is a pipe handling apparatus implementing a base supporting a pivoting boom having a pipe receiving trough along its upper surface. The boom has an upper end which can be placed adjacent to and raised to the height H of a derrick or rig floor (not shown), and a lower end which is movable along the base. Typically the lower end is guided in a cavity in the base which also serves to receive the boom therein when lowered. An arm pivots between the base and the boom for raising the boom from the base to the floor height. At the end of a pipe lowering operation, as well as during transport or storage, the boom is retracted to nest into the cavity.

Although effective to raise the upper end to a predetermined height H, this type of prior art pipe handling apparatus does not readily permit adaptation to raise the upper end to a range of different rig floor heights. A variety of other pipe handling systems are known, such as, for example, U.S. Pat. No. 4,371,302 to Frias et al., U.S. Pat. No. 6,533,519 to Tolomon et al., U.S. Pat. No. 7,163,367 to Handley, U.S. Pat. No. 7,021,880 to Morelli et al., U.S. Pat. No. 6,899,510 to Morelli et al. and Canada 2,224,638 to Handley et al., the entireties of each of which are incorporated herein by reference. However, these types of prior art pipe handling systems do not readily permit a variety of horizontal placements of the upper end of the boom, such as closer to, or further back from, a work floor of the rig.

There is a demonstrated needed for a pipe handling system wherein the boom can be raised to meet with a range of derrick or rig floor heights, as well as a range of horizontal positions relative to such derrick or rig floor, without the disadvantages of the prior art.

BRIEF DESCRIPTION OF THE DRAWINGS

Referring to the drawings, several aspects of the present invention are illustrated by way of example, and not by way of limitation, in detail in the figures, wherein.

DETAILED DESCRIPTION OF THE PREFERRED EMBODIMENTS

Figure 1:
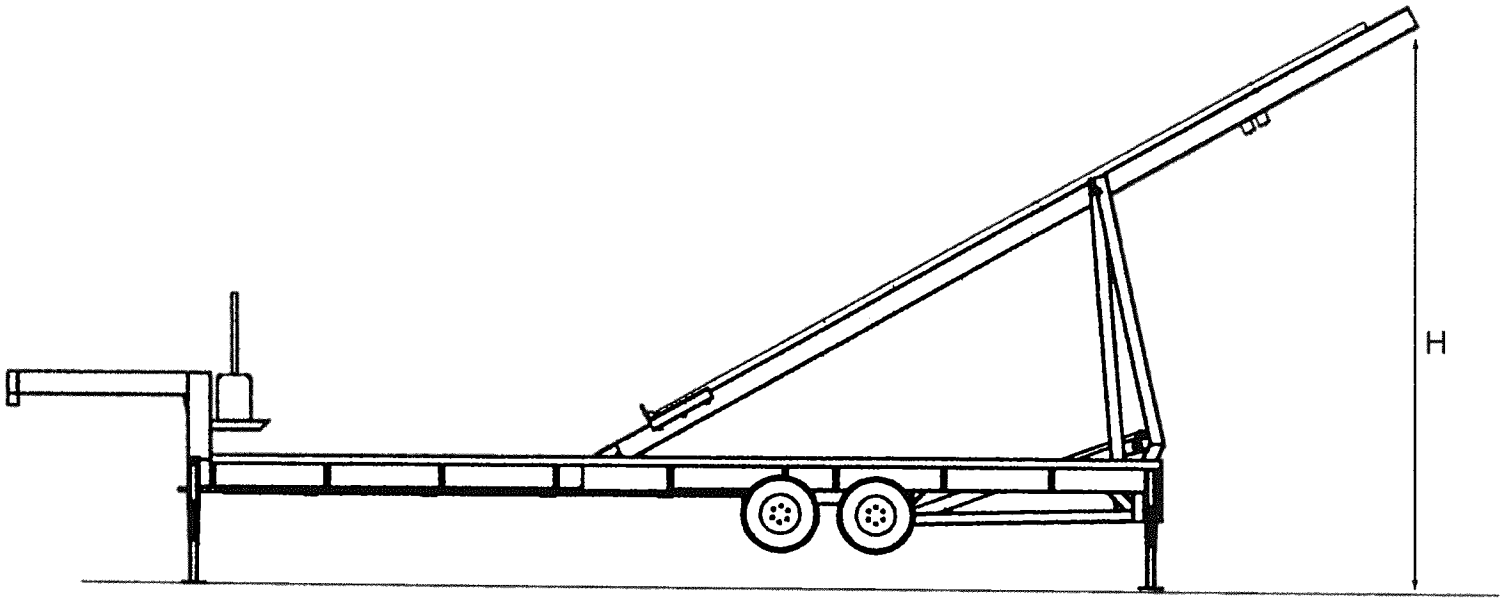
FIG. 1 is a side view of a prior art pipe handling apparatus.

The following description is of a preferred embodiment by way of example only and without limitation to the combination of features necessary for carrying the invention into effect. Reference is to be had to the Figures in which identical reference numbers identify similar components. The drawing figures are not necessarily to scale and certain features are shown in schematic or diagrammatic form in the interest of clarity and conciseness.

Referring to the Figures, various embodiments of a pipe handling apparatus 100 for handling pipe or other tubulars P are shown. The pipe handling apparatus 100 comprises a longitudinal base 105 slidably supporting a boom carrying member 110 and typically includes conventional suitable power supply and controls (not shown). Although base 105 is shown in a stationary embodiment, a person of skill in the art would understand that base 105 may also be of the mobile variety, such as being placed on a transportable trailer or being provided with suitable wheels.

Boom carrying member 110 is capable of axial or sliding movement M, relative to the base 105 and along the longitudinal axis A of base 105. Preferably, rollers or wheels 115 are provided on each side of the boom carrying member 110, said rollers 115 then slidably supporting boom carrying member 110 on the base 105. More preferably, said roller 115 are moveable within longitudinal channels or guides 107 in the base 105. Boom carrying member 110 supports a boom 120 which comprises a trough 140, for receiving pipe P therein.

Figure 2A:
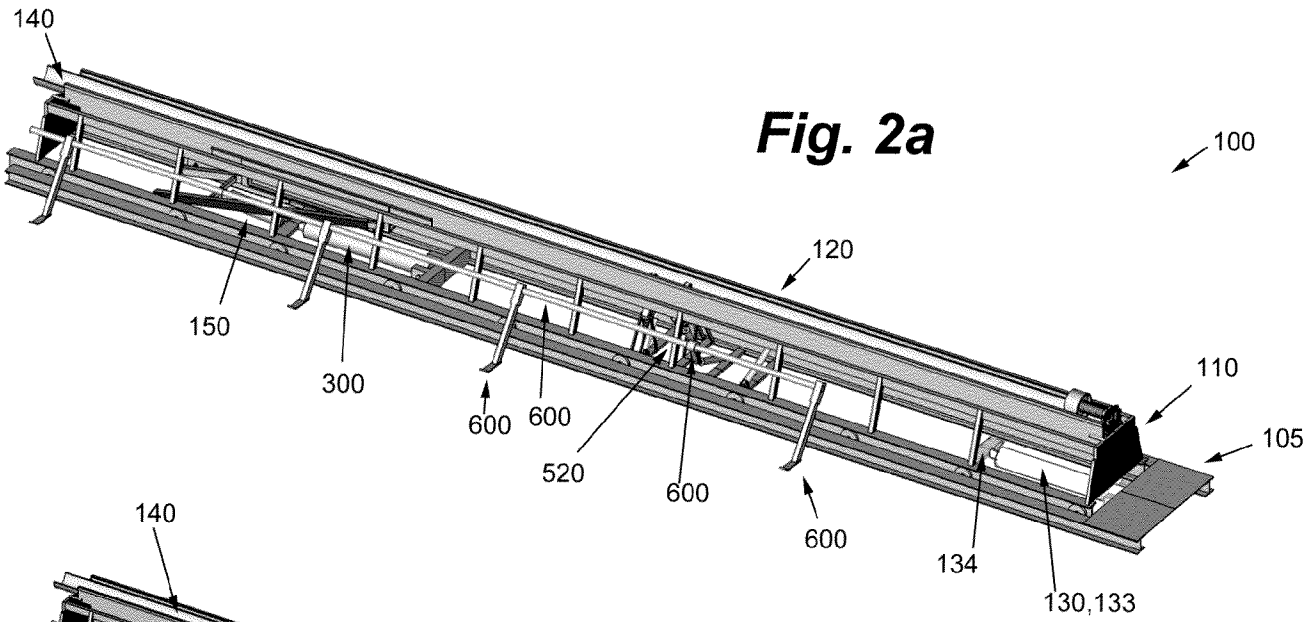
FIGS. 2*a*-2*f* are various perspective views of one embodiment of the invention, illustrating the boom being retracted into a cavity in a boom carrying member and also illustrating various horizontal positioning of the boom carrying member relative to a base.
Figure 2B:
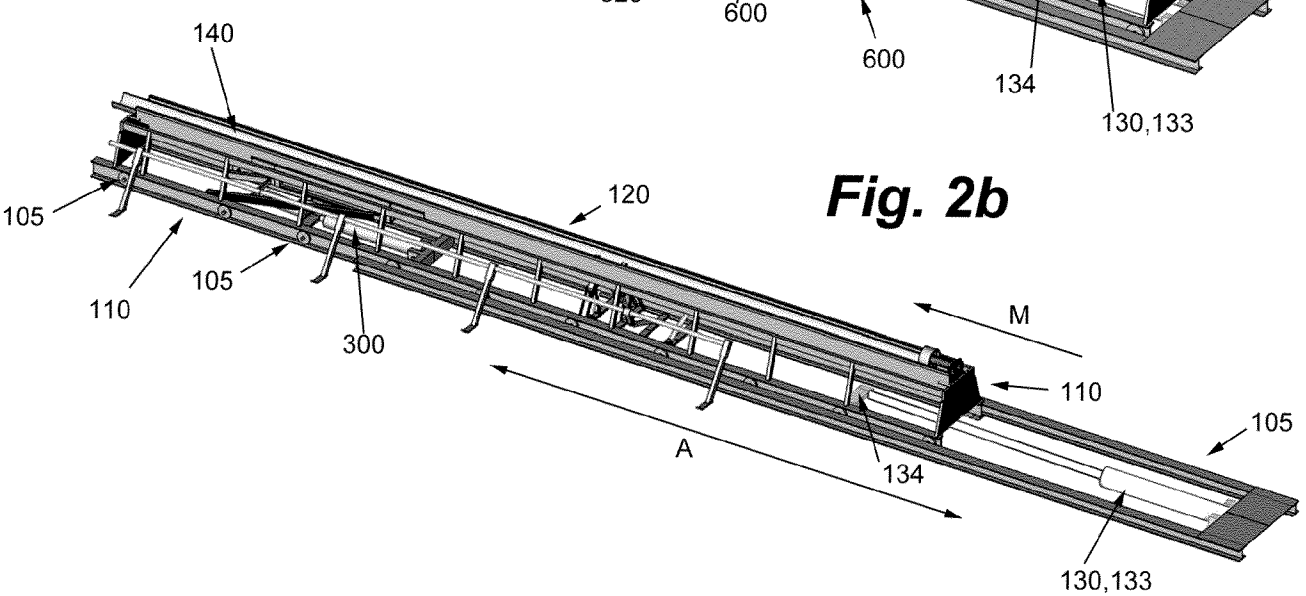
Figure 2C:
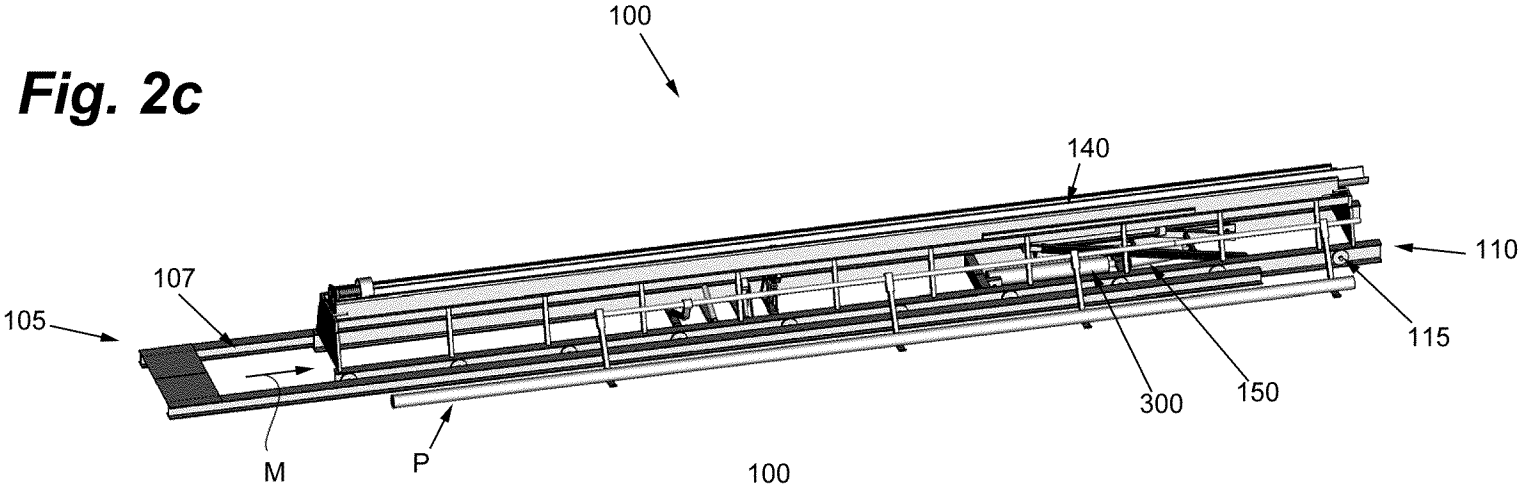

Member actuating means 130 are operable to move the boom carrying member 110 relative to the base 105. Preferably, member actuating means 130 comprise a hydraulic ram 133 and suitable linkage 134 which act between the base 105 and the boom carrying member 110, for the purpose of positioning boom carrying member 110 at various desirable positions along the base's longitudinal axis A (see, for example, FIGS. 2*a* and 2*b*).

Figure 4A:
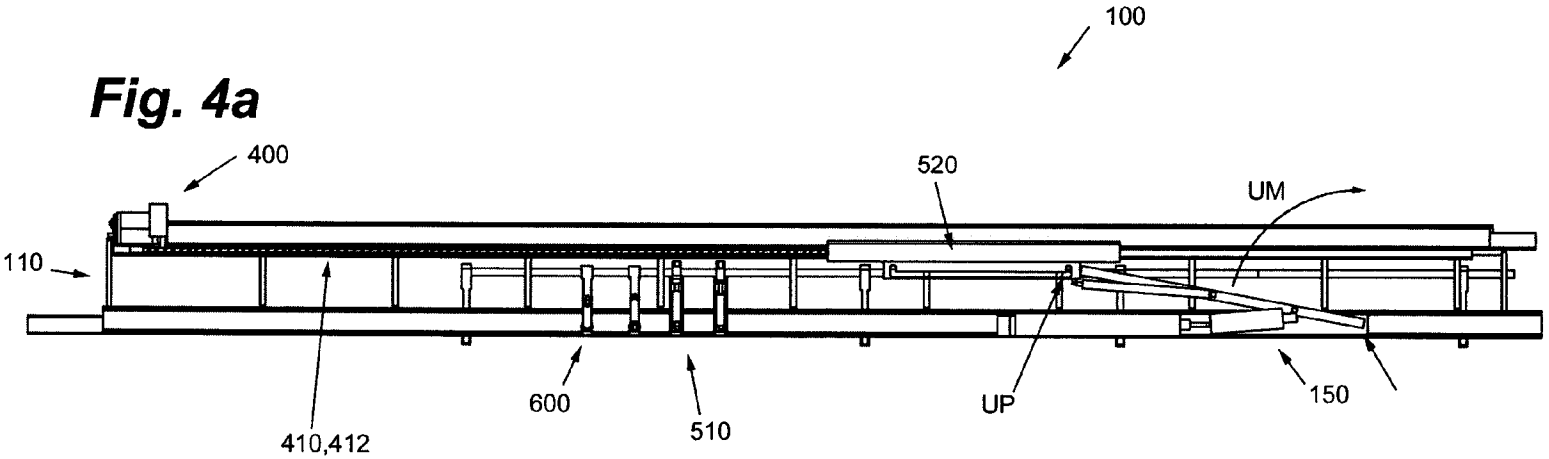
FIGS. 4*a*-4*b* are side views of the embodiment of FIG. 2*a*, illustrating the boom being completely retracted into the boom carrying member (FIG. 4*a*) and at an intermediate height (FIG. 4*b*)
Figure 4B:
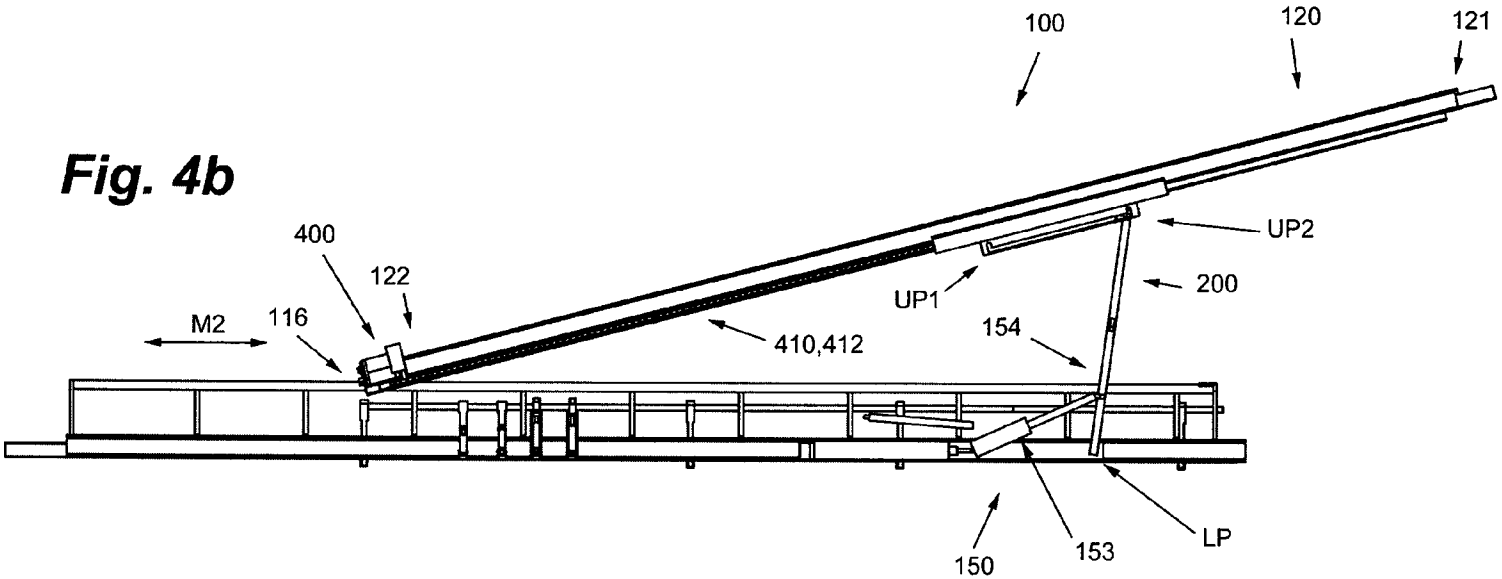
Figure 5A:
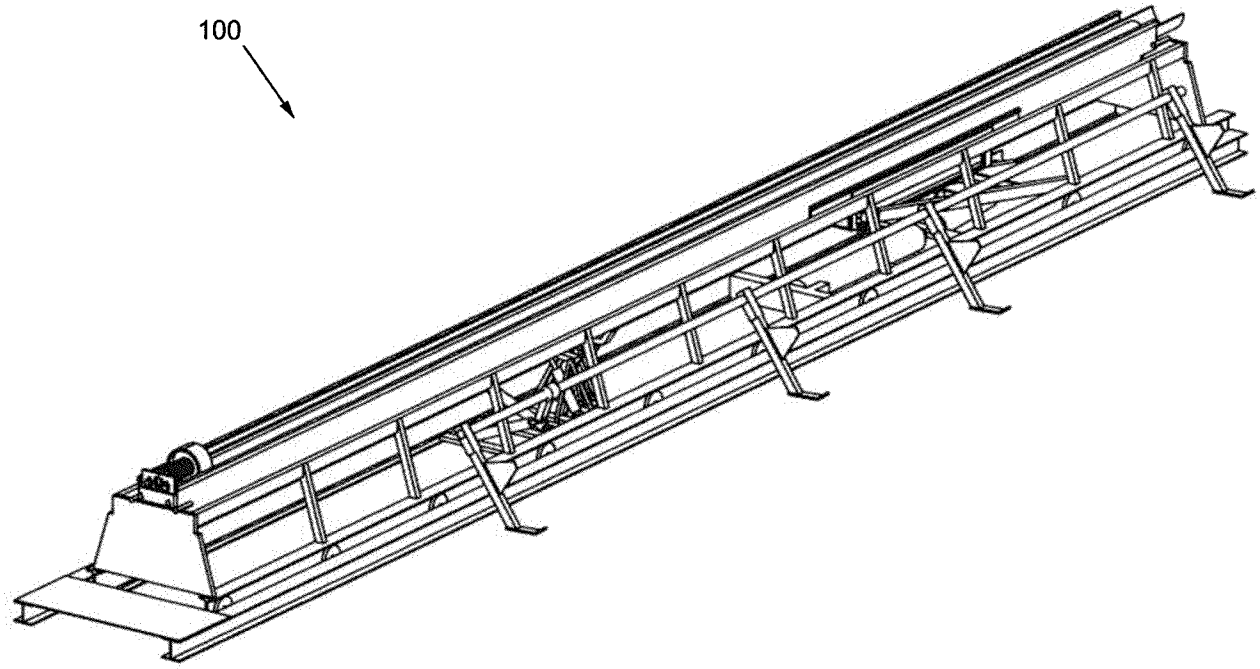
FIGS. 5*a*-5*b* are perspective views of another embodiment of the invention, similar to the embodiment of FIG. 2*a;*
Figure 5B:
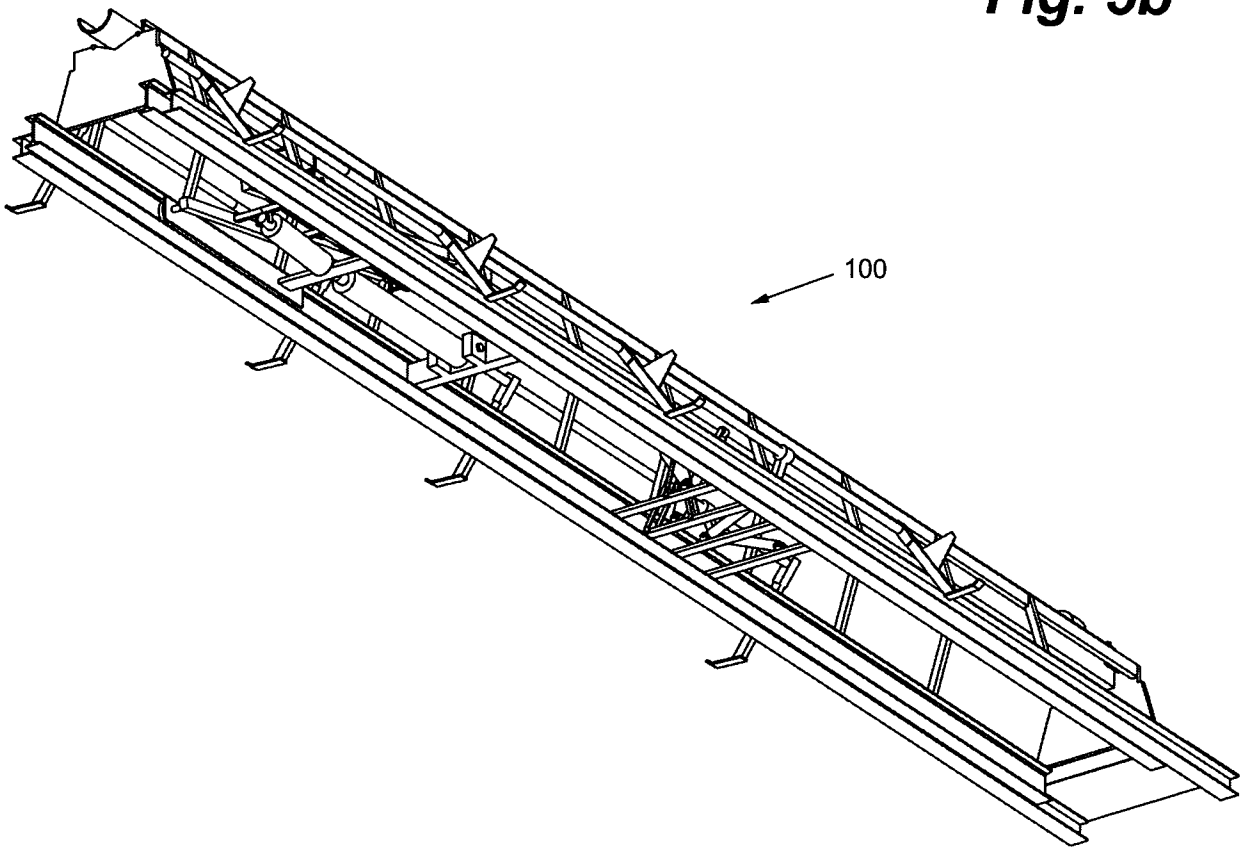

Boom carrying member 110 supports boom 120 in a variety of positions. For example, in FIG. 4*b* boom 120 is shown with a proximal end 121 in a raised position and positioned towards a derrick work floor (not shown) and a distal end 122 in a lowered position within the boom carrying member 110. Herein, the terms proximal and distal are used in relation to the a rig floor, the extreme end of the boom adjacent the rig floor being referred to as the proximal end 121.

Figure 2D:
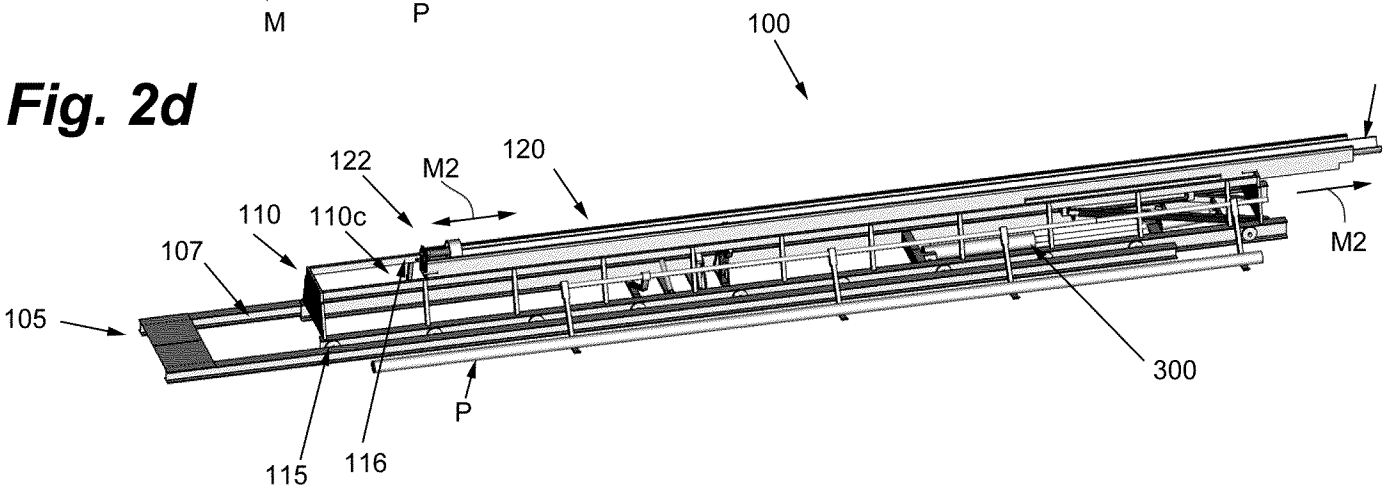
Figure 2E:
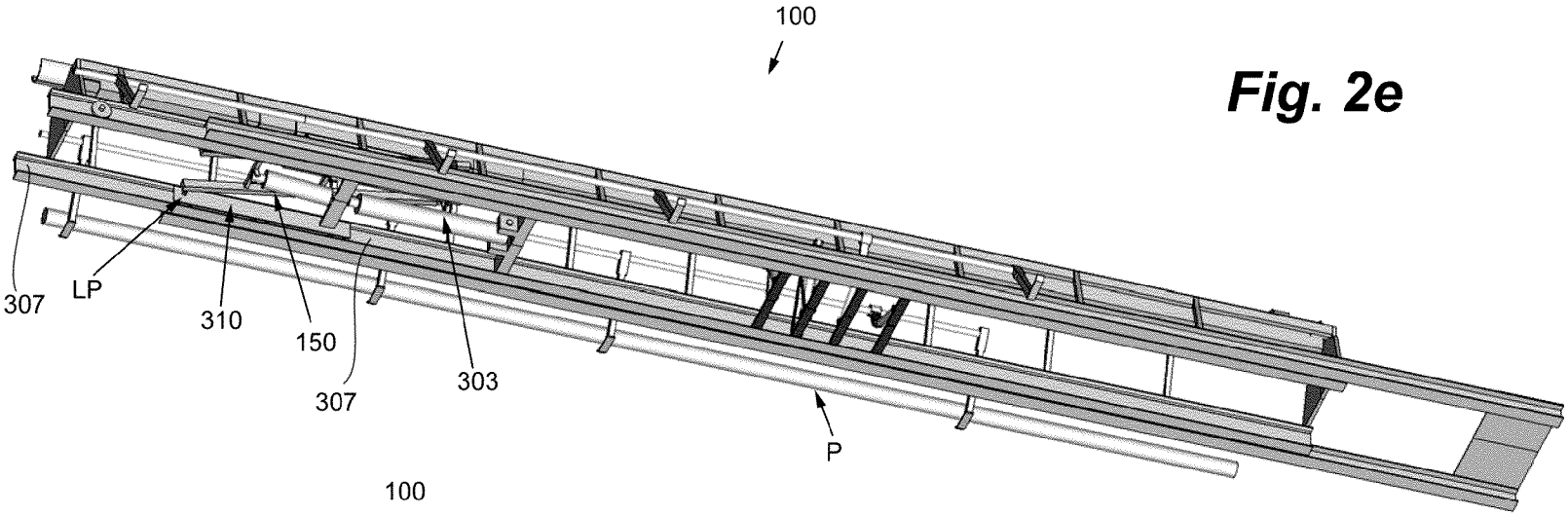
Figure 2F:
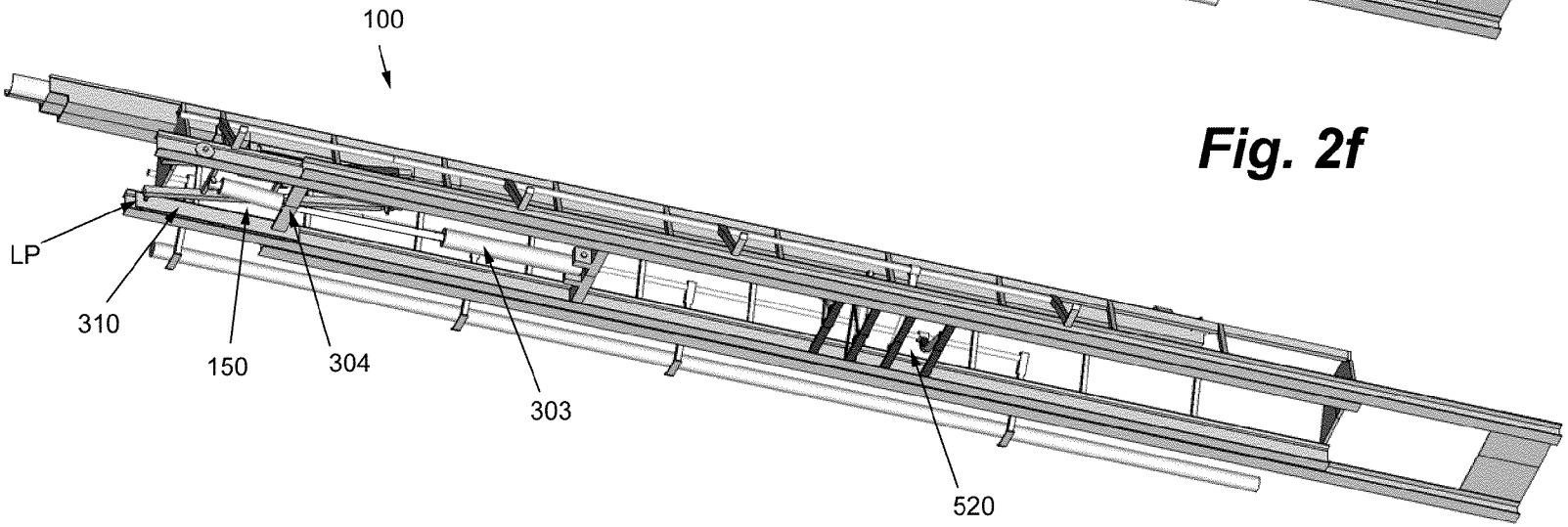

Boom actuating means 150 are operable to raise the boom's proximal end 121 and lower the boom 120 substantially parallel to the boom carrying member 110. Boom 120 is adapted for raising out of and lowering into nestable positioning into a longitudinal cavity 110*c* within boom carrying member 110. The boom is preferably nestled in a longitudinal cavity 110*c* when fully lowered (see, for example, FIG. 2*d*).

Figure 6A:
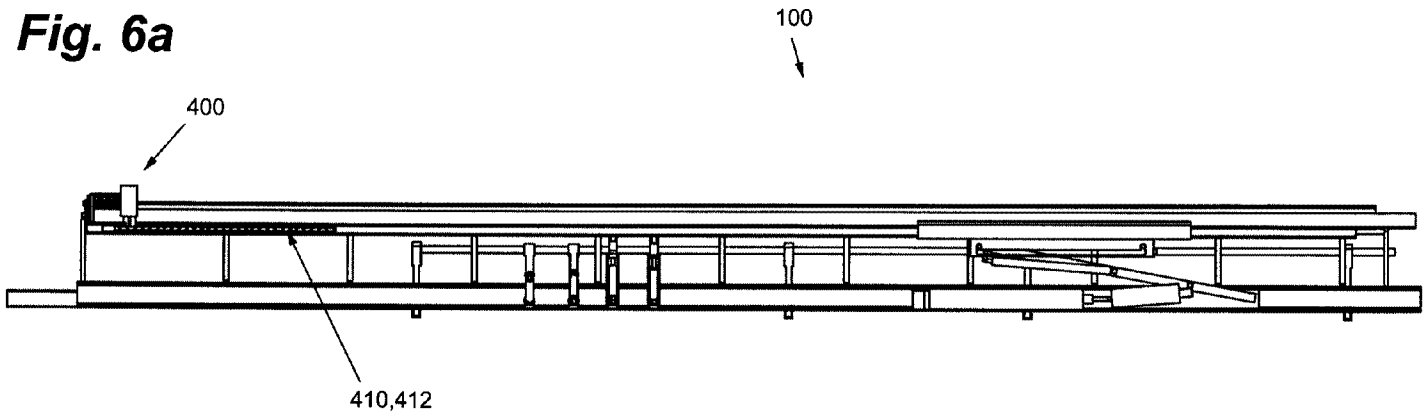
FIGS. 6*a*-6*e* are side views of the embodiment of FIG. 5*a*, illustrating various boom vertical and horizontal positioning.
Figure 6B:
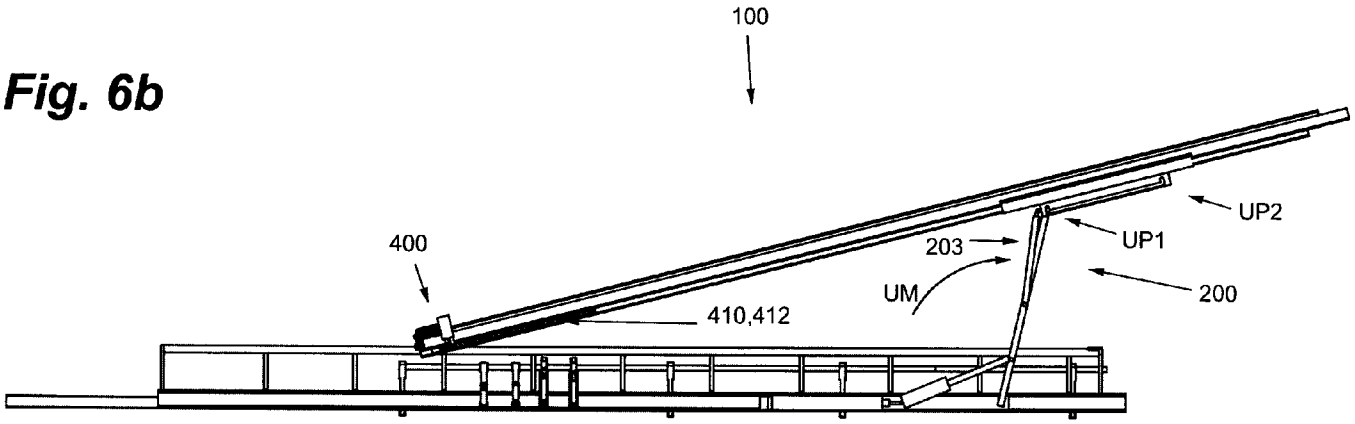

As the boom 120 is raised out of the cavity 110*c*, the proximal end 121 moves towards the derrick work floor (generally as indicated by UM) with the distal end 122 moving longitudinally along longitudinal cavity 110*c* (generally as indicated by M2). Preferably, the movement of distal end is 122 guided by track means 116 and thereby prevent any vertical movement of distal end 122. Preferably, boom actuating means 150 comprise a hydraulic ram 153 and suitable linkage 154 which act between the boom carrying member 110 and the boom 120, for the purpose of positioning the boom's proximal end 121 at various positions, such as in a raised position towards a rig floor (see, for example, FIGS. 4*d* and 6*b*) or in a lowered, nestable position (see, for example, FIGS. 4*a* and 6*a*). More preferably, and to facilitate said raising and lowering movement, linkage 154 pivots at a lower pivot point LP and an upper pivot point UP.

Figure 2G:
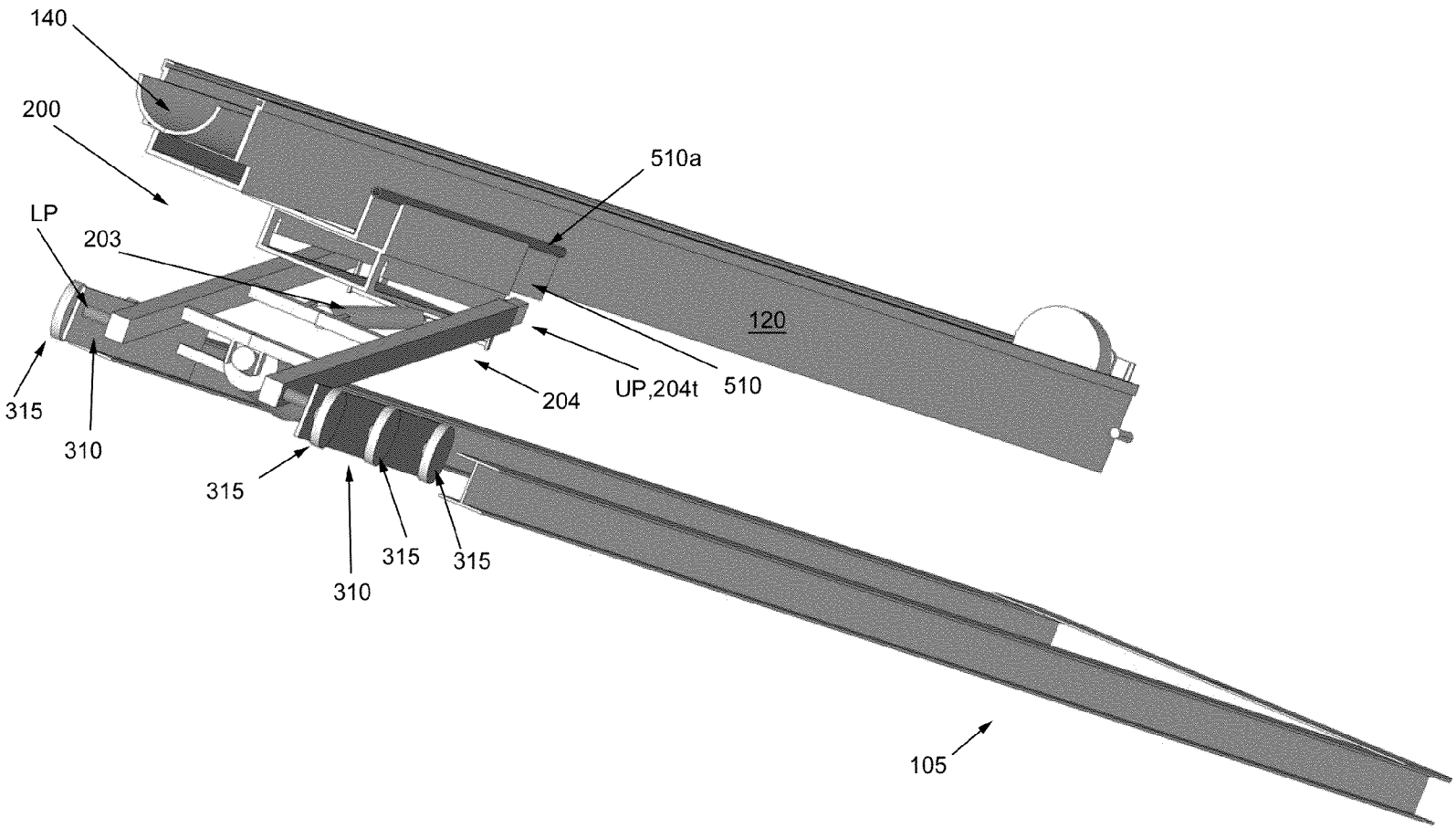
FIG. 2*g* is a perspective view of some of the components of the embodiment of FIG. 2*a;*
Figure 3A:
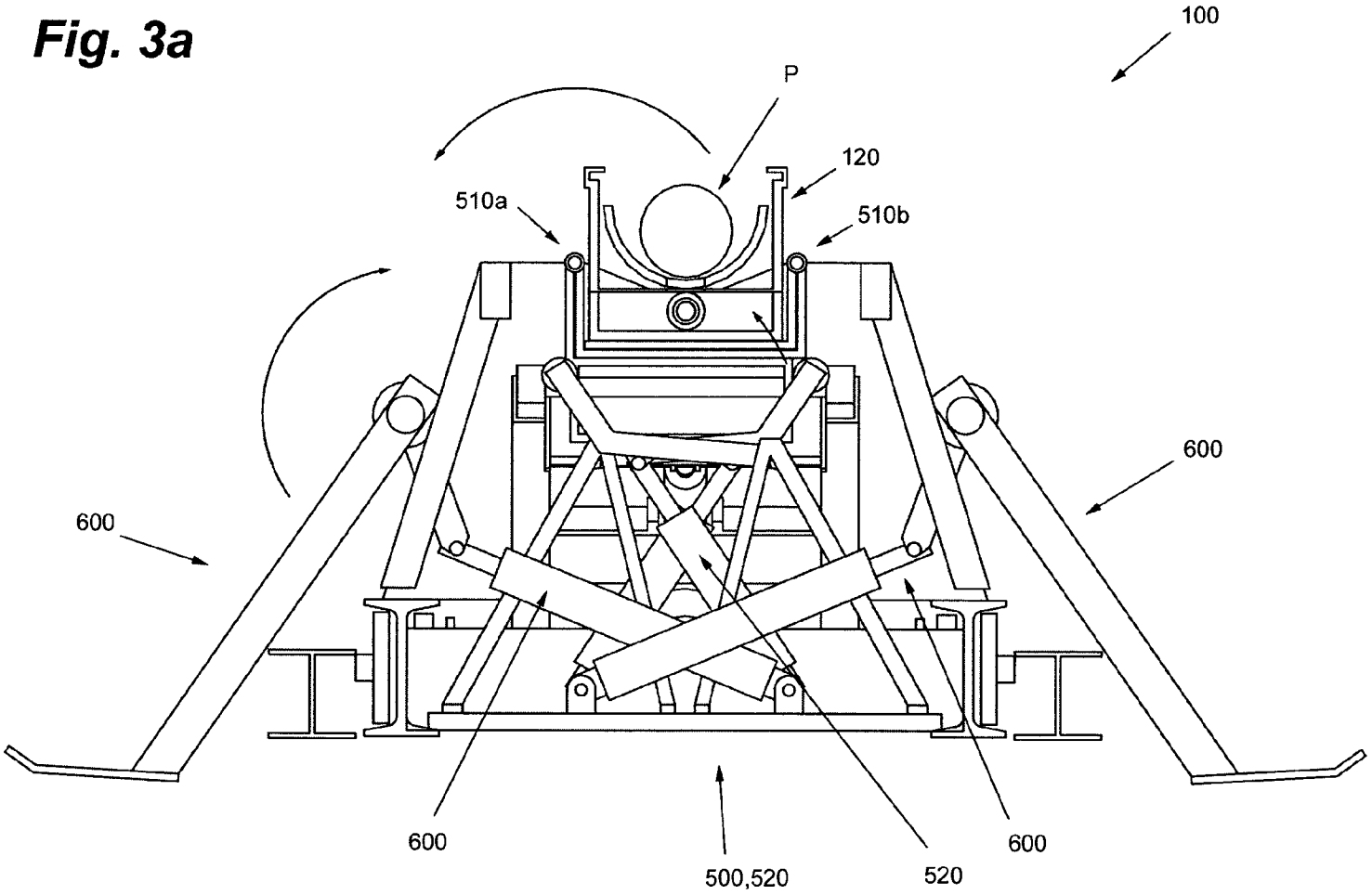
FIGS. 3*a*-3*e* are end views of some of the components of the embodiment of FIG. 2*a;*
Figure 3B:
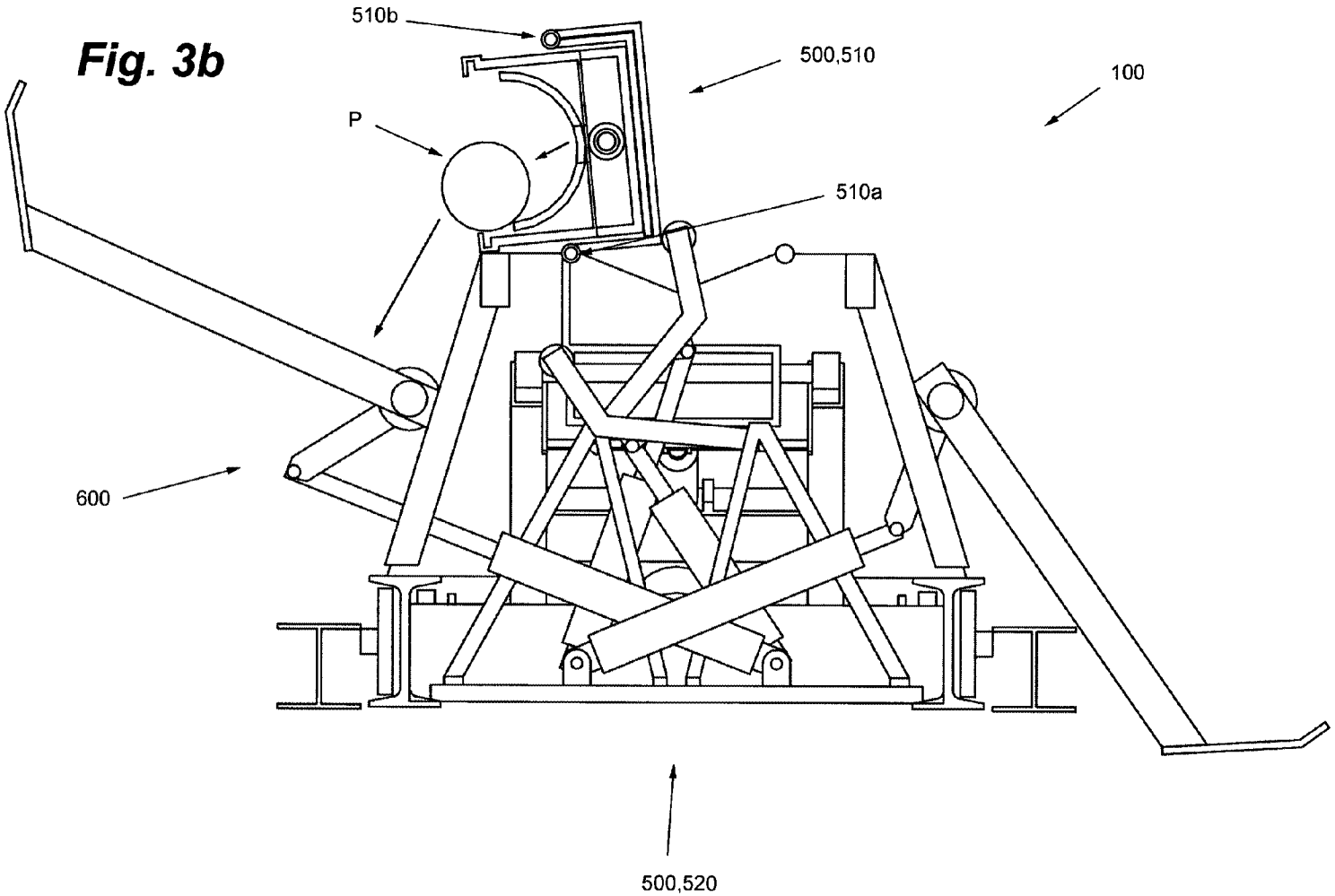
Figure 3C:
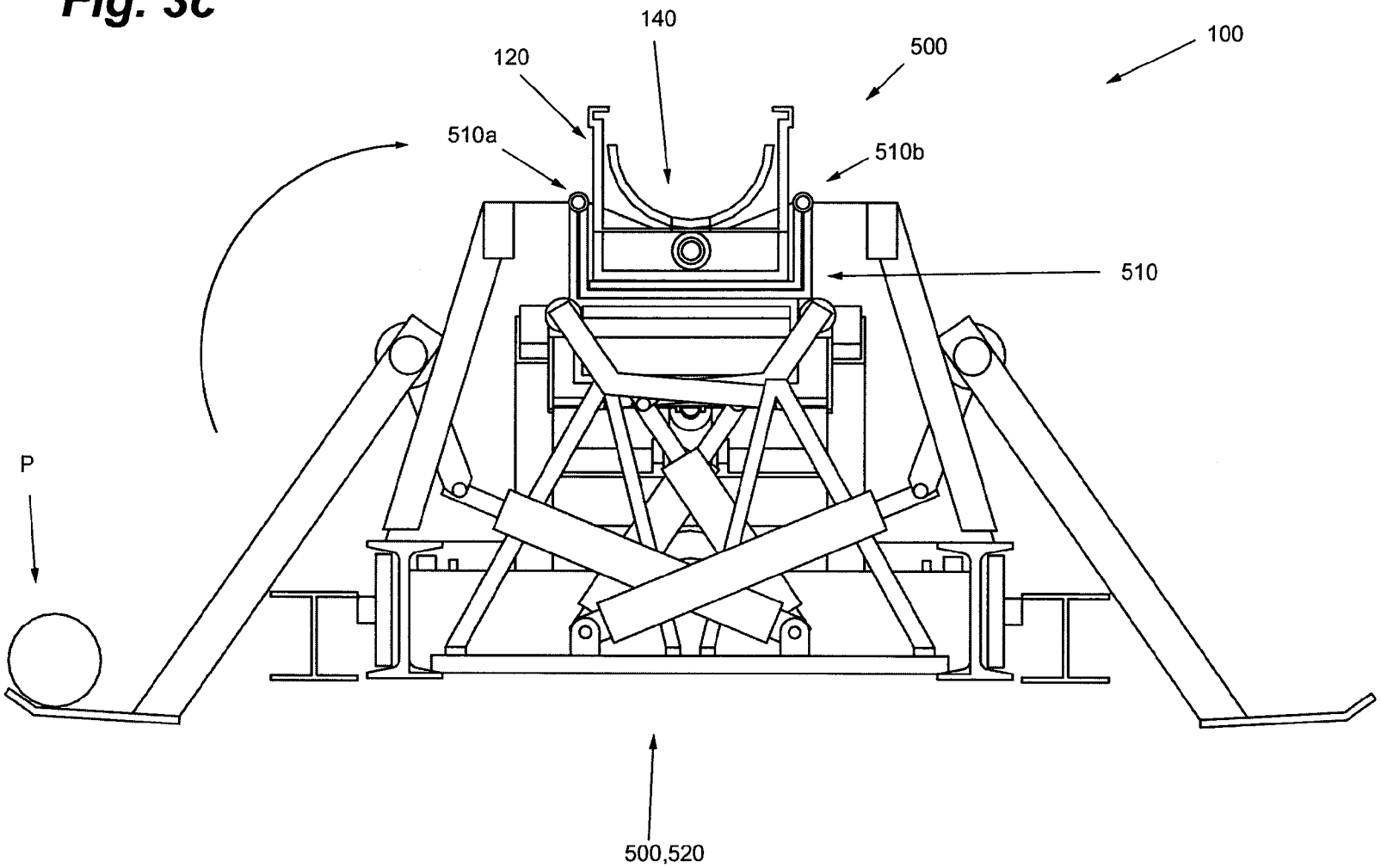
Figure 3D:
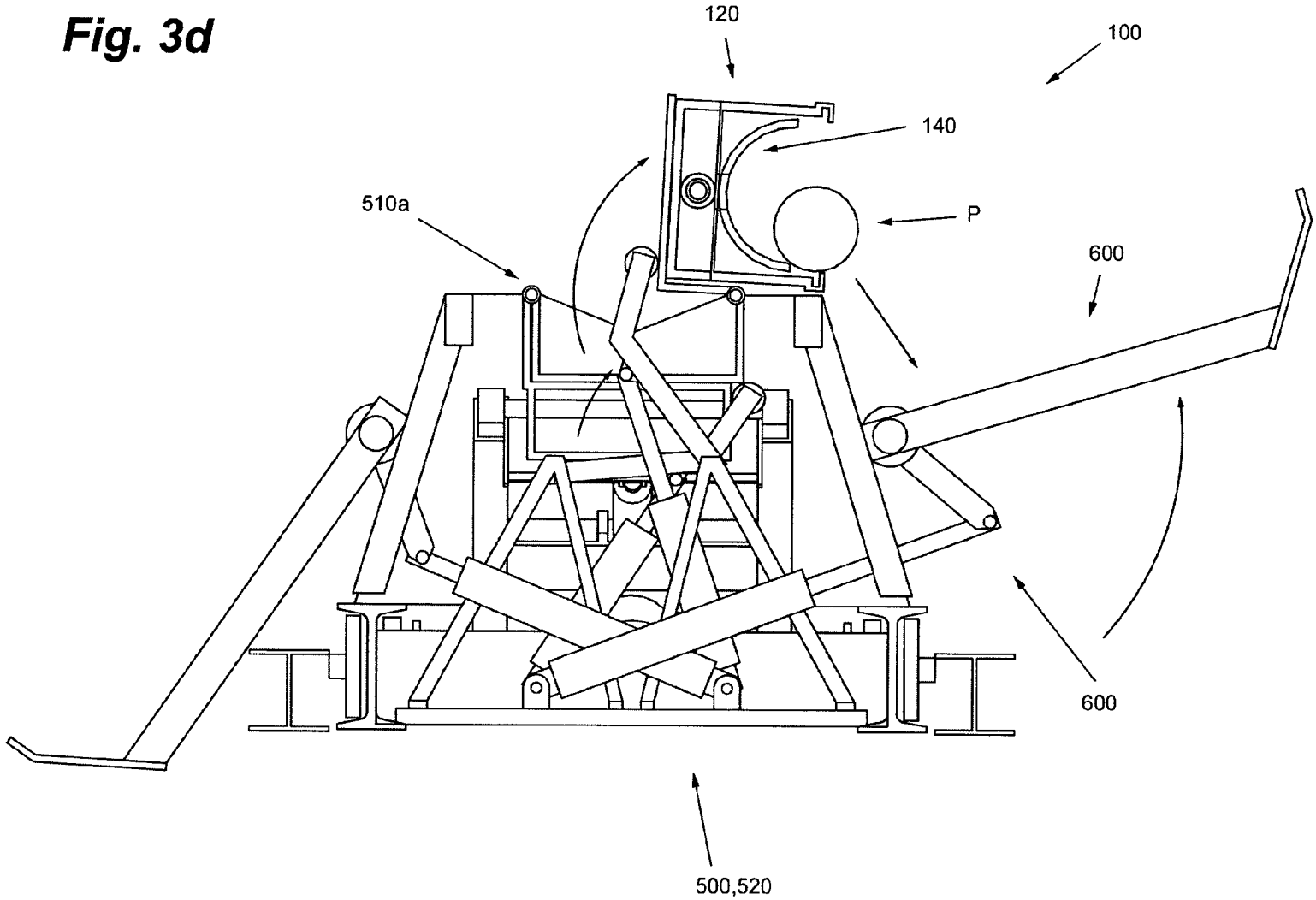
Figure 3E:
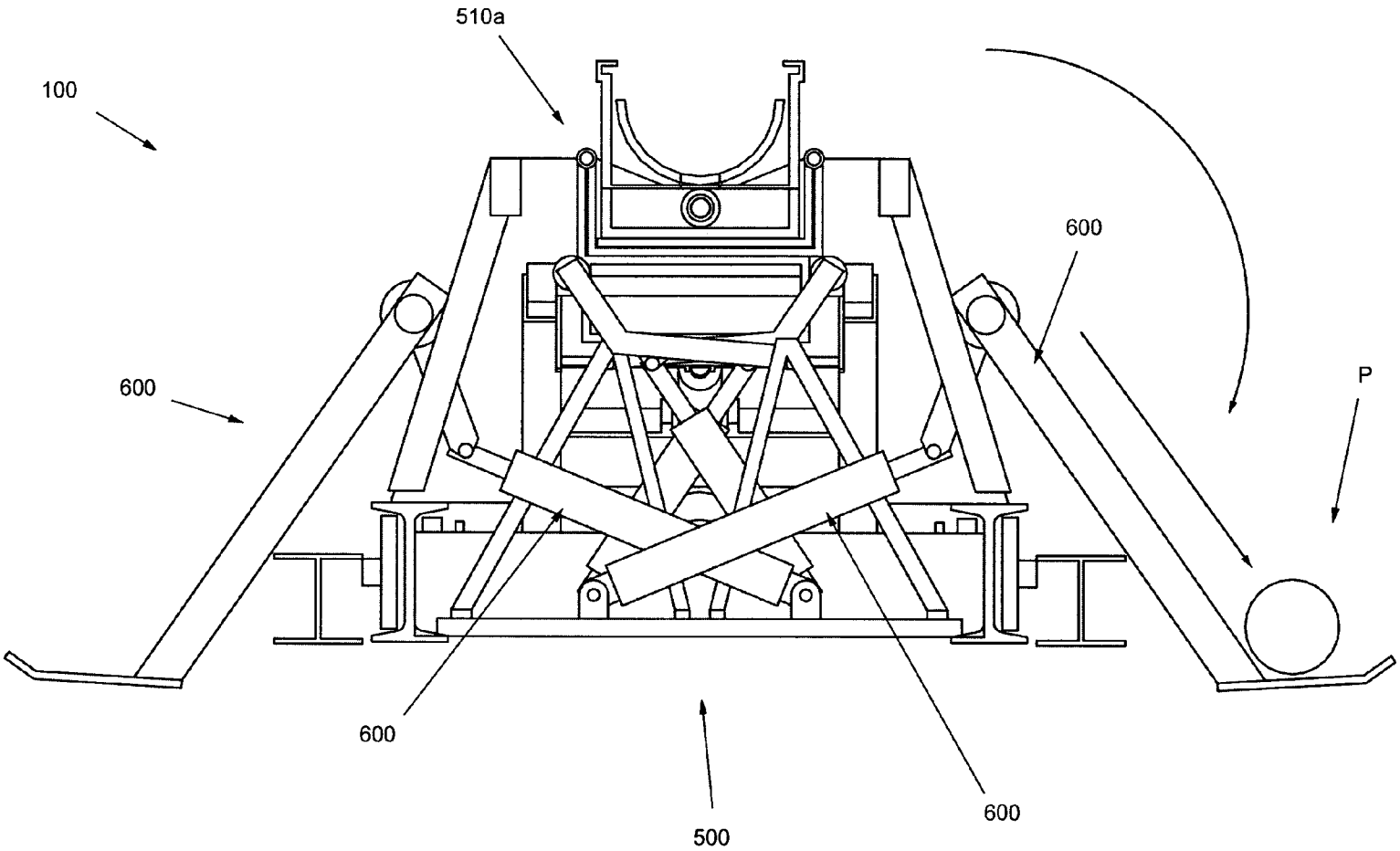
Figure 6C:
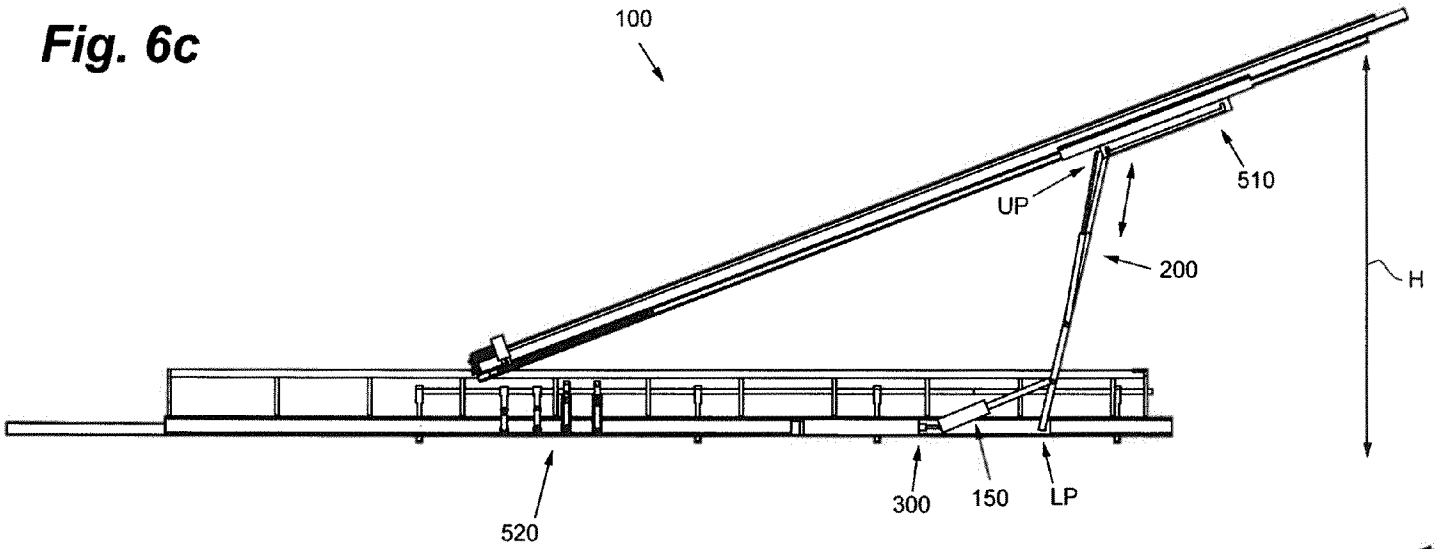

Preferably, the pipe handling apparatus 100 further comprises height adjustment means 200 to position the boom's proximal end 121 at a desirable height H, such as at the height of a rig floor, or to provide fine adjustments to the height of the boom's proximal end 121. Preferably, height adjustment means 200 comprise a hydraulic ram 203 and suitable linkage 204 which act between the boom carrying member 110 and the boom 120 (see FIG. 2*g*), for the purpose of positioning the boom's proximal end 121 at various heights, such as in a raised position towards a rig floor (see, for example, FIG. 6*c*) or in an intermediate position (see, for example, FIG. 6*b*). More preferably, the linkage 204 is a telescoping linkage 204*t*.

Preferably, the pipe handling apparatus 100 further comprises horizontal adjustment means 300 to position the boom 120 at a desirable horizontal position HP, such as at the edge of a rig floor, or to provide fine adjustments to the horizontal positioning of the boom's proximal end 121. Preferably, horizontal adjustment means 300 comprise a hydraulic ram 303 and suitable linkage 304 which act between the boom carrying member 110 and the boom actuating means 150 (see, for example, FIG. 2*a*), for the purpose of positioning the boom 120 at various horizontal positions relative to the boom carrying member (see, for example, FIGS. 2*c*-2*d* and 6*c*-6*d*). More preferably, horizontal adjustment means 300 further comprises a carriage 310 slidably supported by boom carrying member 110 and, in turn, supporting boom actuating means 150. Preferably, rollers or wheels 315 are provided on each side of the carriage 310, said rollers 315 then slidably supporting carriage 310 on, or within, boom carrying member 110. More preferably, said rollers 315 are moveable within longitudinal channels or guides 307 in the boom carrying member 110. Horizontal adjustment means 300 may be actuated to move proximal end 1212 of boom 120 at a desired horizontal position HP, with distal end 122 of boom 120 moving longitudinally along longitudinal cavity 110*c* (generally as indicated by M2).

Figure 6D:
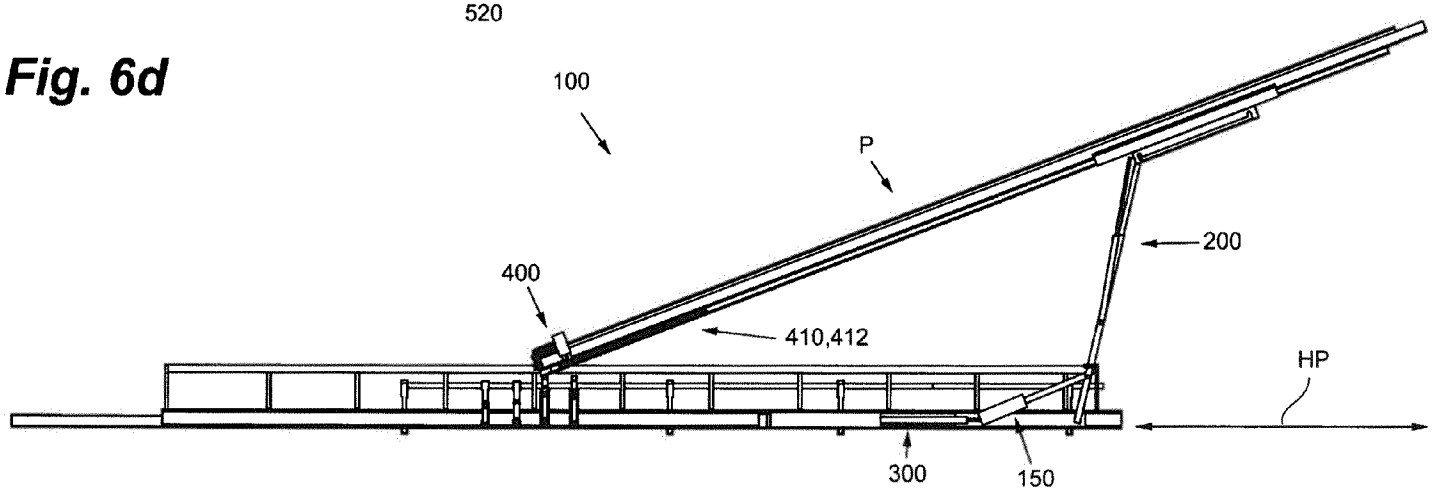
Figure 6E:
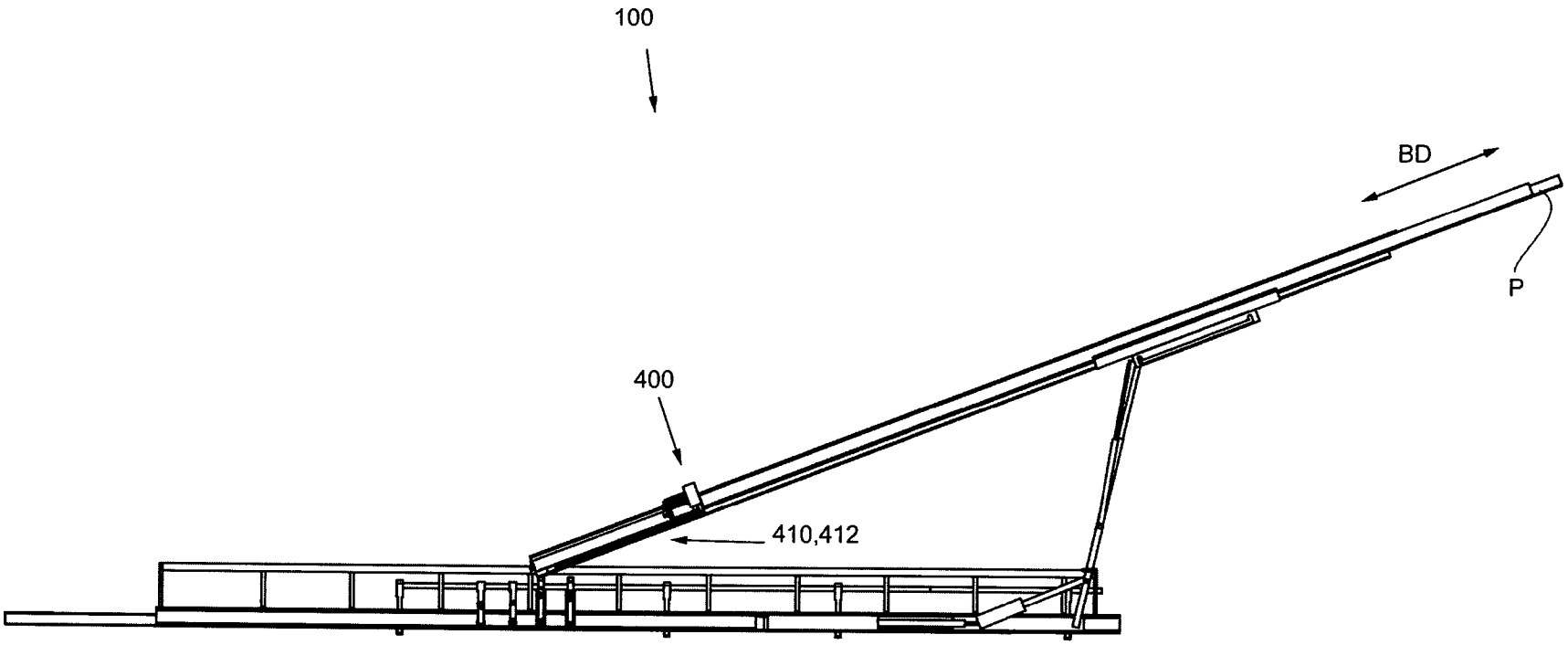

Preferably, the pipe handling apparatus 100 further comprises carriage means 400 to carry the distal end of a pipe P in a bi-directional manner BD between proximal end 121 and distal end 122 of boom 120 (see FIGS. 6*d*-6*e*). More preferably, carriage means is driven by a leadscrew-based power means 410, further comprising a leadscrew 412 mounted substantially parallel within boom 120, a motor (not shown) to drive the leadscrew and a nut (not shown) mounted on the carriage means 400 to receive and treadably mate with the leadscrew 412.

Preferably, the pipe handling apparatus 100 further comprises boom tilting means 500 which is operable, when the boom 120 is lowered into the longitudinal cavity 110*c*, for the purpose of ejecting, or receiving, pipe P laterally to or from the trough 140 (see FIGS. 3*a*-3*e*). More preferably, boom tilting means 500 comprises boom support member 510 and lateral actuating means 520. Even, more preferably boom support member 510 is a double hinged member, having two hinge points 510*a*, 510*b*, each oriented substantially parallel to the longitudinal axis A. Boom tilting means 500 is able to laterally tilt boom 120 in either direction along the longitudinal axis A (see FIGS. 3*b* and 3*d*).

Preferably, boom support member 510 is provided between boom 120 at one end and the linkage 154 and height adjustment means 200 at the other end. More preferably, boom support member 510 provides a plurality of upper pivot points UP1, UP2, to selectably, securably receive linkage 154 as may be desired and so as to provide yet further variation/selection in boom height H (see, for example, FIG. 4*b* versus FIG. 6*b*). Even more preferably lateral actuating means 520 is provided at a different location, such as between a different part of the boom 120 and boom carrying member 110, preferably at a location closer to the distal end 122. Lateral actuating means 520 is preferably comprised of conventional hydraulic rams, linkages and rollers (such as illustrated in FIGS. 3*a*-3*e*).

Preferably, the pipe handling apparatus 100 further comprises pipe handling arms 600 which are operable, when the boom 120 is lowered into the longitudinal cavity 110*c*, for purpose of the assisting the boom tilting means 500 with ejecting, or receiving, pipe P laterally to or from the trough 140 (see FIGS. 3*a*-3*e*). Pipe handling arms 600 are preferably comprised of conventional hydraulic rams and linkages (such as illustrated in FIGS. 3*a*-3*e*).

Advantageously, by selectively utilizing and actuating member actuating means 130, boom actuating means 150, height adjustment means 200 and horizontal adjustment means 300, the pipe apparatus 100 can position pipe P through a range of horizontal HP and vertical (height) H positions, see, for example FIGS. 6*a*-6*e*.

The embodiments of the invention in which an exclusive property or privilege is being claimed are defined as follows:

1. A pipe handling apparatus for handling sections of pipe to and from a derrick work floor, the apparatus comprising:

a longitudinal base having a first longitudinal axis;

a boom carrying member having a second longitudinal axis, said boom carrying member slidably mounted to the longitudinal base for telescoping axial movement along said first longitudinal axis;

a longitudinal cavity within boom carrying member;

member actuating means operable to move the boom carrying member axially relative to the longitudinal base along the first longitudinal axis;

a boom supported by said boom carrying member, the boom having a proximal end proximal to the derrick work floor, a distal end distal from the derrick work floor, and a trough extending along the boom and adapted for receiving at least one section of pipe therein, the distal end of the boom being movably guided substantial horizontal along the longitudinal cavity of boom carrying member, so as to prevent substantial vertical movement of said distal end during operations; and boom actuating means operable to raise and lower the boom's proximal end;

wherein when the boom carrying member is moved along the first longitudinal axis of the longitudinal base, said first longitudinal axis and said second longitudinal axis are substantially parallel.

2. The pipe handling apparatus of claim 1, further comprising height adjustment means to position the boom's proximal end at a desirable height.

3. The pipe handling apparatus of claim 2, wherein the height adjustment means comprises a hydraulic ram and linkage which acts between the boom carrying member and the boom.

4. The pipe handling apparatus of claim 3, wherein the linkage is a telescoping linkage.

5. The pipe handling apparatus of claim 1, further comprising horizontal adjustment means, acting between the boom carrying member and the boom, to position the boom at a desired horizontal position relative to the boom carrying member.

6. The pipe handling apparatus of claim 5, wherein the horizontal adjustment means comprises a carriage slidably supported by the boom carrying member, said carriage supporting said boom actuating means.

7. The pipe handling apparatus of claim 1, further comprising carriage means to carry pipe in a bi-directional manner between the boom's proximal and distal ends.

8. The pipe handling apparatus of claim 1, further comprising boom tilting means to laterally tilt the boom in either direction along the second longitudinal axis.

9. The pipe handling apparatus of claim 8, wherein the boom tilting means further comprises a boom support member and lateral actuating means.

10. The pipe handling apparatus of claim 9, wherein the boom support member is a double hinged member having two hinge points, each hinge point oriented substantially parallel to each other and to the second longitudinal axis.

11. The pipe handling apparatus of claim 2, further comprising horizontal adjustment means, acting between the boom carrying member and the boom, to position the boom at a desired horizontal position relative to the boom carrying member.

12. The pipe handling apparatus of claim 2, further comprising carriage means to carry pipe in a bi-directional manner between the boom's proximal and distal ends.

13. The pipe handling apparatus of claim 5, further comprising carriage means to carry pipe in a bi-directional manner between the boom's proximal and distal ends.

14. The pipe handling apparatus of claim 2, further comprising boom titling means to laterally tilt the boom in either direction along the second longitudinal axis.

15. The pipe handling apparatus of claim 5, further comprising boom titling means to laterally tilt the boom in either direction along the second longitudinal axis.

16. The pipe handling apparatus of claim 7, further comprising boom titling means to laterally tilt the boom in either direction along the second longitudinal axis.

17. A pipe handling apparatus for handling sections of pipe to and from a derrick work floor, the apparatus comprising:

a longitudinal base having a first longitudinal axis;

a boom carrying member having a second longitudinal axis, said boom carrying member slidably mounted to the longitudinal base for telescoping axial movement along said first longitudinal axis, said first longitudinal axis and said second longitudinal axis being substantially parallel;

a longitudinal cavity within boom carrying member substantially along said second longitudinal axis;

a boom supported by said boom carrying member, the boom having a third longitudinal axis, a proximal end proximal to the derrick work floor, a distal end distal from the derrick work floor, and a trough extending along the boom and adapted for receiving at least one section of pipe therein, the distal end of the boom being movably guided substantially horizontal along the longitudinal cavity of boom carrying member, so as to prevent substantial vertical movement of said distal end during operations, the proximal end being movable into and out of the longitudinal cavity of the boom carrying member;

boom actuating means operable to raise and lower the boom's proximal end;

member actuating means to position the boom carrying member at a desired horizontal position along the first longitudinal axis; and horizontal adjustment means, acting between the boom carrying member and the boom, to position the boom at a desired horizontal position relative to the boom carrying member;

wherein the boom is substantially nestled in the longitudinal cavity when fully lowered; and wherein, when the boom is substantially nestled in the longitudinal cavity and when horizontal adjustment means positions boom at a desired horizontal position, said first longitudinal axis, said second longitudinal axis and said third longitudinal axis are all substantially parallel.

18. The pipe handling apparatus of claim 17, wherein the horizontal adjustment means comprises a carriage slidably supported by the boom carrying member, said carriage supporting said boom actuating means.

19. The pipe handling apparatus of claim 18, wherein the horizontal adjustment means further comprises a hydraulic ram and linkage which acts between the boom carrying member and the boom actuating means.

20. The pipe handling apparatus of claim 1, wherein the boom is substantially nestled in the longitudinal cavity when fully lowered.

21. The pipe handling apparatus of claim 1, further comprising track means to movably guide the distal end of the boom along the longitudinal cavity of boom carrying member and to prevent substantial vertical movement of said distal end.

22. The pipe handling apparatus of claim 17, further comprising track means to movably guide the distal end of the boom along the longitudinal cavity of boom carrying member and to prevent substantial vertical movement of said distal end.

* * * * *